US011623463B2

(12) United States Patent
Tamai et al.

(10) Patent No.: US 11,623,463 B2
(45) Date of Patent: Apr. 11, 2023

(54) RECORDING APPARATUS

(71) Applicant: SEIKO EPSON CORPORATION, Tokyo (JP)

(72) Inventors: Satoshi Tamai, Matsumoto (JP); Shintaro Komuro, Matsumoto (JP); Nobuhiko Shinozaki, Okaya (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 28 days.

(21) Appl. No.: 17/185,440

(22) Filed: Feb. 25, 2021

(65) Prior Publication Data

US 2021/0268818 A1 Sep. 2, 2021

(30) Foreign Application Priority Data

Feb. 28, 2020 (JP) ..... JP2020-033145

(51) Int. Cl.
*B41J 13/10* (2006.01)
*B41J 11/00* (2006.01)
*B41J 29/393* (2006.01)

(52) U.S. Cl.
CPC ..... *B41J 29/393* (2013.01); *B41J 11/0095* (2013.01); *B41J 13/106* (2013.01)

(58) Field of Classification Search
CPC ..... B41J 13/106; B41J 29/38; B41J 11/0095; B41J 29/02; B41J 29/13
See application file for complete search history.

(56) References Cited

U.S. PATENT DOCUMENTS 5,251,890 A 10/1993 Sasai
2004/0090509 A1* 5/2004 Silverbrook ..... B41J 13/076 347/103
2013/0077114 A1* 3/2013 Short ..... G03G 15/6552 358/1.13
2013/0258416 A1* 10/2013 Nakano ..... B65H 31/02 358/296
2017/0251116 A1* 8/2017 Miyamoto ..... B41J 29/13

FOREIGN PATENT DOCUMENTS

JP H03-279161 A 12/1991

* cited by examiner

*Primary Examiner* — Scott A Richmond
(74) *Attorney, Agent, or Firm* — Workman Nydegger

(57) ABSTRACT

A recording apparatus includes: a medium receiving tray that is switchable between a housed state of being retracted inside apparatus body that includes a recording unit and a protruding state of protruding from the apparatus body relative to the housed state; a power source that switches the medium receiving tray between the housed state and the protruding state; and a medium detection unit that detects whether there is the medium on the medium receiving tray or not. When an error is detected during execution of a recording job, a control unit, which controls the power source based on detection information of the medium detection unit, determines whether there is the medium on the medium receiving tray or not. When the control unit determines that there is no medium on the medium receiving tray, the control unit switches the medium receiving tray into the housed state.

5 Claims, 8 Drawing Sheets

RECORDING APPARATUS

The present application is based on, and claims priority from JP Application Serial Number 2020-033145, filed Feb. 28, 2020, the disclosure of which is hereby incorporated by reference herein in its entirety.

BACKGROUND

1. Technical Field

Embodiments of the present disclosure relate to a recording apparatus that performs recording on a medium.

2. Related Art

Some recording apparatuses such as facsimiles and printers are equipped with a tray configured to receive a sheet-type medium ejected after recording thereon. Some such trays are switchable between a housed state and an extended state by receiving motive power from a power source. If such a tray is left in an extended state, depending on the installation conditions of the apparatus, the tray protruding from the apparatus might be obstructive when a person walks through the passage. To solve this problem, JP-A-3-279161 discloses a technique of switching the tray from the extended state into the housed state when it is determined that sheets of the medium that were present on the tray are now absent, based on detection by a detector provided for detecting the presence or absence of the sheets on the tray. In addition, JP-A-3-279161 discloses that the tray is not switched from the extended state into the housed state even if it is determined that sheets of the medium that were present on the tray are now absent during sheet ejection, that is, before a job finishes.

Although the tray is switched from the extended state into the housed state when predetermined conditions are met in the above technique disclosed in JP-A-3-279161, there is a room for further improvement in terms of greater user friendliness.

SUMMARY

A recording apparatus according to a certain aspect of the present disclosure includes: an apparatus body that includes a recording unit that performs recording on a medium; a medium receiving tray that is switchable between a housed state, in which the medium receiving tray is retracted inside the apparatus body, and a protruding state, in which the medium receiving tray protrudes from the apparatus body relative to the housed state, the medium receiving tray being configured to receive the medium ejected when in the protruding state; a power source that switches the medium receiving tray between the housed state and the protruding state; a medium detection unit that detects whether there is the medium on the medium receiving tray or not; and a control unit that controls the power source based on detection information of the medium detection unit; wherein when an error is detected during execution of a recording job, the control unit determines whether there is the medium on the medium receiving tray or not, and when the control unit determines that there is no medium on the medium receiving tray, the control unit switches the medium receiving tray into the housed state.

A recording apparatus according to another aspect of the present disclosure includes: an apparatus body that includes a recording unit that performs recording on a medium; a medium receiving tray that is switchable between a housed state, in which the medium receiving tray is retracted inside the apparatus body, and a protruding state, in which the medium receiving tray protrudes from the apparatus body relative to the housed state, the medium receiving tray being configured to receive the medium ejected when in the protruding state; a power source that switches the medium receiving tray between the housed state and the protruding state; a medium detection unit that detects whether there is the medium on the medium receiving tray or not; a person presence detection sensor that detects presence of a person approaching the apparatus body; and a control unit that controls the power source based on detection information of the medium detection unit and detection information of the person presence detection sensor; wherein the control unit shifts into a power saving mode when a predetermined time has elapsed in a recording standby state while the medium receiving tray is in the protruding state with the medium placed on the medium receiving tray, and upon detecting the approaching of the person by the person presence detection sensor during execution of the power saving mode, the control unit returns from the power saving mode, determines whether there is the medium on the medium receiving tray or not when returning from the power saving mode, and switches the medium receiving tray into the housed state when the control unit determines that there is no medium on the medium receiving tray.

DESCRIPTION OF EXEMPLARY EMBODIMENTS

Figure 1:
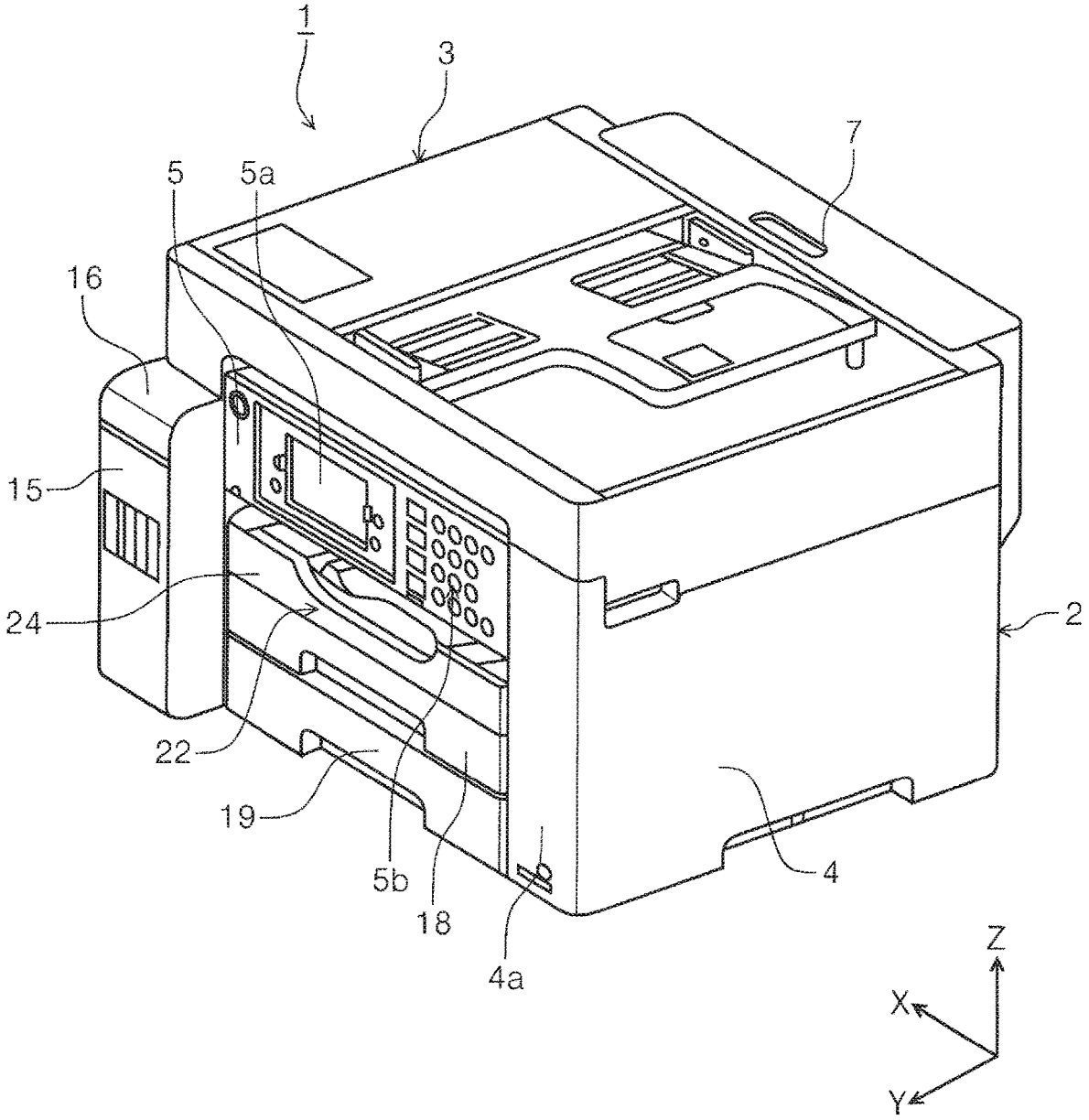
FIG. 1 is a perspective view of a printer when an ejected paper tray is in a housed state.

First, a brief overview of the present disclosure is presented below.

A recording apparatus according to a first mode includes: an apparatus body that includes a recording unit that performs recording on a medium; a medium receiving tray that is switchable between a housed state, in which the medium receiving tray is retracted inside the apparatus body, and a protruding state, in which the medium receiving tray protrudes from the apparatus body relative to the housed state, the medium receiving tray being configured to receive the medium ejected when in the protruding state; a power source that switches the medium receiving tray between the housed state and the protruding state; a medium detection unit that detects whether there is the medium on the medium receiving tray or not; and a control unit that controls the power source based on detection information of the medium detection unit; wherein when an error is detected during execution of a recording job, the control unit determines whether there is the medium on the medium receiving tray or not, and when the control unit determines that there is no medium on the medium receiving tray, the control unit switches the medium receiving tray into the housed state.

If an error occurs during the execution of a recording job, the user takes an action suitable for clearing the error on the recording apparatus. If the medium receiving tray were in the protruding state, the medium receiving tray might be obstructive to the user's work when the user attempts to clear the error. In the present mode, when an error is detected during execution of a recording job, the control unit determines whether there is the medium on the medium receiving tray or not, and when the control unit determines that there is no medium on the medium receiving tray, the control unit switches the medium receiving tray into the housed state. Therefore, it is possible to prevent the medium receiving tray from being obstructive when the user takes an action suitable for clearing the error on the recording apparatus. The meaning of the housed state of the medium receiving tray is not limited to a state in which the medium receiving tray is completely retracted inside the apparatus body. The medium receiving tray can be said to be in the housed state even if a part of the medium receiving tray protrudes from the apparatus body, as long as the medium receiving tray is not in use right now.

A second mode is that, in the first mode, when the medium detection unit determines that there is the medium on the medium receiving tray, the control unit outputs an alert for prompting the medium to be removed from the medium receiving tray, and when the medium detection unit then determines that there is no medium on the medium receiving tray, the control unit switches the medium receiving tray into the housed state.

Even when there is the medium on the medium receiving tray, the present mode makes it possible to expect that the medium will be removed from the medium receiving tray because an alert for prompting the medium to be removed from the medium receiving tray is outputted. Since the medium receiving tray is switched into the housed state if it is then determined that there is no medium on the medium receiving tray, it is possible to prevent the medium receiving tray from being obstructive when the user takes an action suitable for clearing the error on the recording apparatus.

A third mode is that, in the first mode or the second mode, the apparatus body includes, below the medium receiving tray, a medium container unit inside which the medium to be fed is containable, and the error is an error caused due to running out of the medium inside the medium container unit.

In the present mode, the error is an error caused due to running out of the medium inside the medium container unit, and, in order to clear the error, the user takes an action such as detaching the medium container unit from the apparatus body or replenishing the medium container unit with a medium. Since the medium receiving tray, which is located above the medium container unit, is switched into the housed state, it is possible to prevent the medium receiving tray from being obstructive to the user's work when such an action is taken.

A fourth mode is that, in the first mode or the second mode, the apparatus body includes the medium receiving tray in a front portion of the recording apparatus and a feeding tray in a rear portion of the recording apparatus, the medium to be fed being configured to be placed on the feeding tray, and the error is an error caused due to running out of the medium on the feeding tray.

In the present mode, the error is an error caused due to running out of the medium on the feeding tray, and, in order to clear the error, the user takes an action, specifically, replenishes the feeding tray in the rear portion of the recording apparatus with a medium. Since the medium receiving tray in the front portion of the recording apparatus is switched into the housed state, it is possible to prevent the medium receiving tray in the front portion of the recording apparatus from being obstructive to the user's work when such an action is taken.

A fifth mode is that, in the first mode or the second mode, the error is an error caused due to jamming of the medium inside the apparatus body. In the present mode, the error is an error caused due to jamming of the medium inside the apparatus body, and, in order to clear the error, the user takes an action, specifically, removes the jammed medium out of the apparatus body. Since the medium receiving tray is switched into the housed state, it is possible to prevent the medium receiving tray from being obstructive to the user's work in the process of removing the jammed medium.

A sixth mode is that, in the first mode or the second mode, the recording unit is an ink ejection head that ejects ink onto the medium, and the error is an error caused due to running out of the ink. In the present mode, the error is an error caused due to running out of the ink, and the user takes an action for ink replenishment in order to clear the error. Since the medium receiving tray is switched into the housed state, it is possible to prevent the medium receiving tray from being obstructive to the user's work in this process.

A recording apparatus according to a seventh mode includes: an apparatus body that includes a recording unit that performs recording on a medium; a medium receiving tray that is switchable between a housed state, in which the medium receiving tray is retracted inside the apparatus body, and a protruding state, in which the medium receiving tray protrudes from the apparatus body relative to the housed state, the medium receiving tray being configured to receive the medium ejected when in the protruding state; a power source that switches the medium receiving tray between the housed state and the protruding state; a medium detection unit that detects whether there is the medium on the medium receiving tray or not; a person presence detection sensor that detects presence of a person approaching the apparatus body; and a control unit that controls the power source based on detection information of the medium detection unit and detection information of the person presence detection sensor; wherein the control unit shifts into a power saving mode when a predetermined time has elapsed in a recording standby state while the medium receiving tray is in the protruding state with the medium placed on the medium receiving tray, and upon detecting the approaching of the person by the person presence detection sensor during execution of the power saving mode, the control unit returns from the power saving mode, determines whether there is the medium on the medium receiving tray or not when returning from the power saving mode, and switches the medium receiving tray into the housed state when the control unit determines that there is no medium on the medium receiving tray.

The medium receiving tray cannot be switched into the housed state if there is the medium on the medium receiving tray. If the recording apparatus shifts into the power saving mode with the medium receiving tray left in the protruding state, the medium receiving tray cannot be driven even when the medium is removed from the medium receiving tray. By contrast, in the present mode, if the person presence detection sensor detects the approaching of a person, the control unit returns from the power saving mode, determines whether there is the medium on the medium receiving tray or not when returning from the power saving mode, and switches the medium receiving tray into the housed state if it is determined that there is no medium on the medium receiving tray. Therefore, it is possible to prevent the medium receiving tray from obstructing the person to pass. The meaning of the housed state of the medium receiving tray is not limited to a state in which the medium receiving tray is completely retracted inside the apparatus body. The medium receiving tray can be said to be in the housed state even if a part of the medium receiving tray protrudes from the apparatus body, as long as the medium receiving tray is not in use right now.

An eighth mode is that, in the seventh mode, the medium detecting unit determines whether there is the medium on the medium receiving tray or not when returning from the power saving mode, and the control unit outputs an alert for prompting the medium to be removed from the medium receiving tray when the medium detecting unit determines that there is the medium on the medium receiving tray, and when the control unit then determines that there is no medium on the medium receiving tray, the control unit switches the medium receiving tray into the housed state.

Even when there is the medium on the medium receiving tray, the present mode makes it possible to expect that the medium will be removed from the medium receiving tray because an alert for prompting the medium to be removed from the medium receiving tray is outputted. Since the medium receiving tray is switched into the housed state if it is then determined that there is no medium on the medium receiving tray, it is possible to prevent the medium receiving tray from obstructing a person to pass.

Next, embodiments of the present disclosure will now be explained with specific examples.

In the accompanying drawings, the direction along the X axis is defined as a width direction of an apparatus. This direction is the same as a width direction of a document. When a user stands facing the front of the apparatus, the direction toward the right is a −X direction, and the direction toward the left is a +X direction, as viewed by the user. The direction along the Y axis is defined as a depth direction of the apparatus. The direction from the rear toward the front of the apparatus is a +Y direction. The direction from the front toward the rear of the apparatus is a −Y direction. Therefore, a +Y-directional position relative to the center position of an apparatus body 2 in the Y-axis direction is a position that is closer to the front of the apparatus. A −Y-directional position relative to the center position of the apparatus body 2 in the Y-axis direction is a position that is closer to the rear of the apparatus. The direction along the Z axis is defined as a vertical direction. The direction going perpendicularly upward is a +Z direction. The direction going perpendicularly downward is a −Z direction. In the present embodiment, among lateral faces constituting the lateral enclosure of the apparatus, a lateral face on which a tilt panel 5 is provided is explained as the front of the apparatus.

Figure 2:
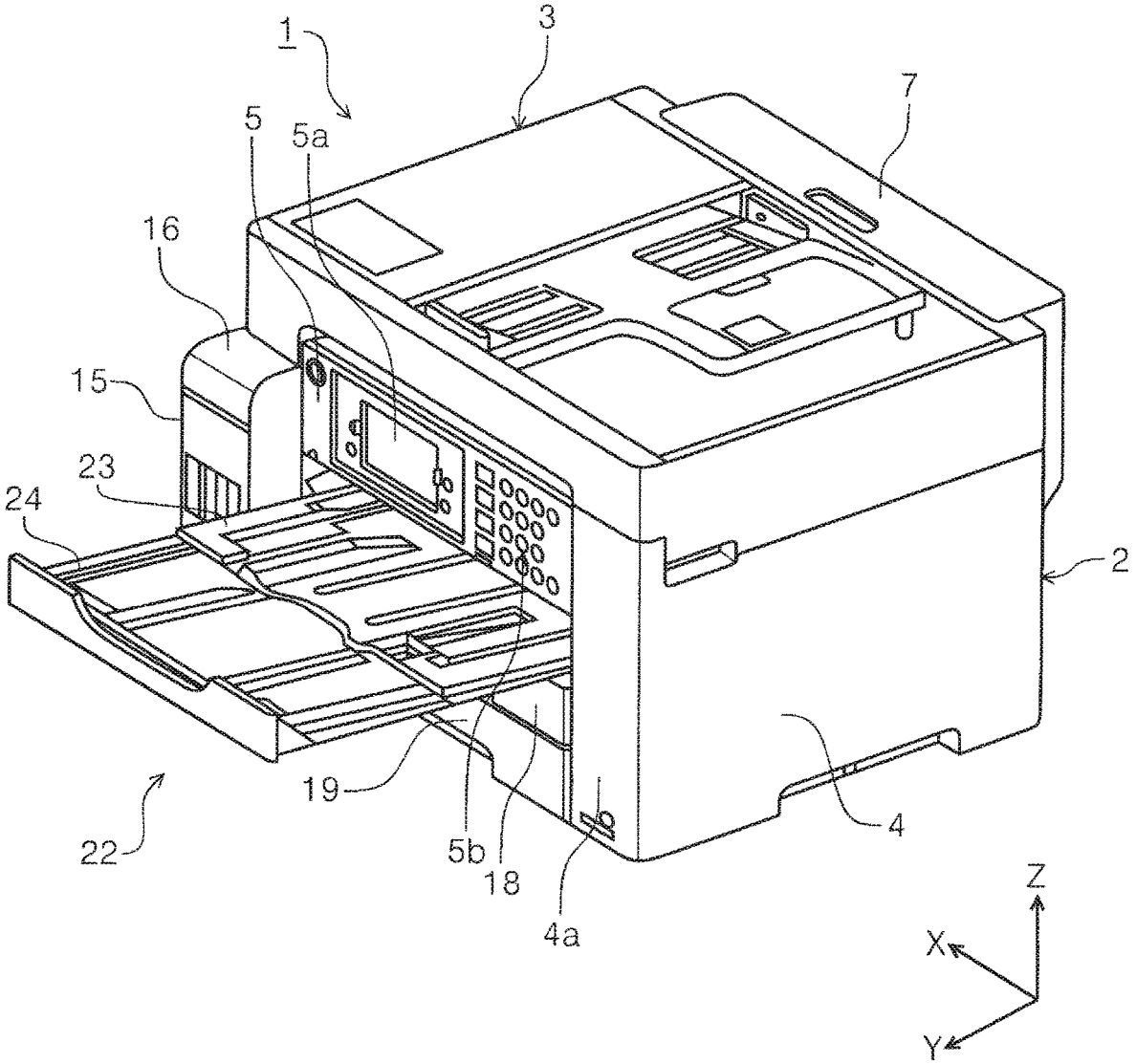
FIG. 2 is a perspective view of the printer when the ejected paper tray is in a second protruding state.
Figure 3:
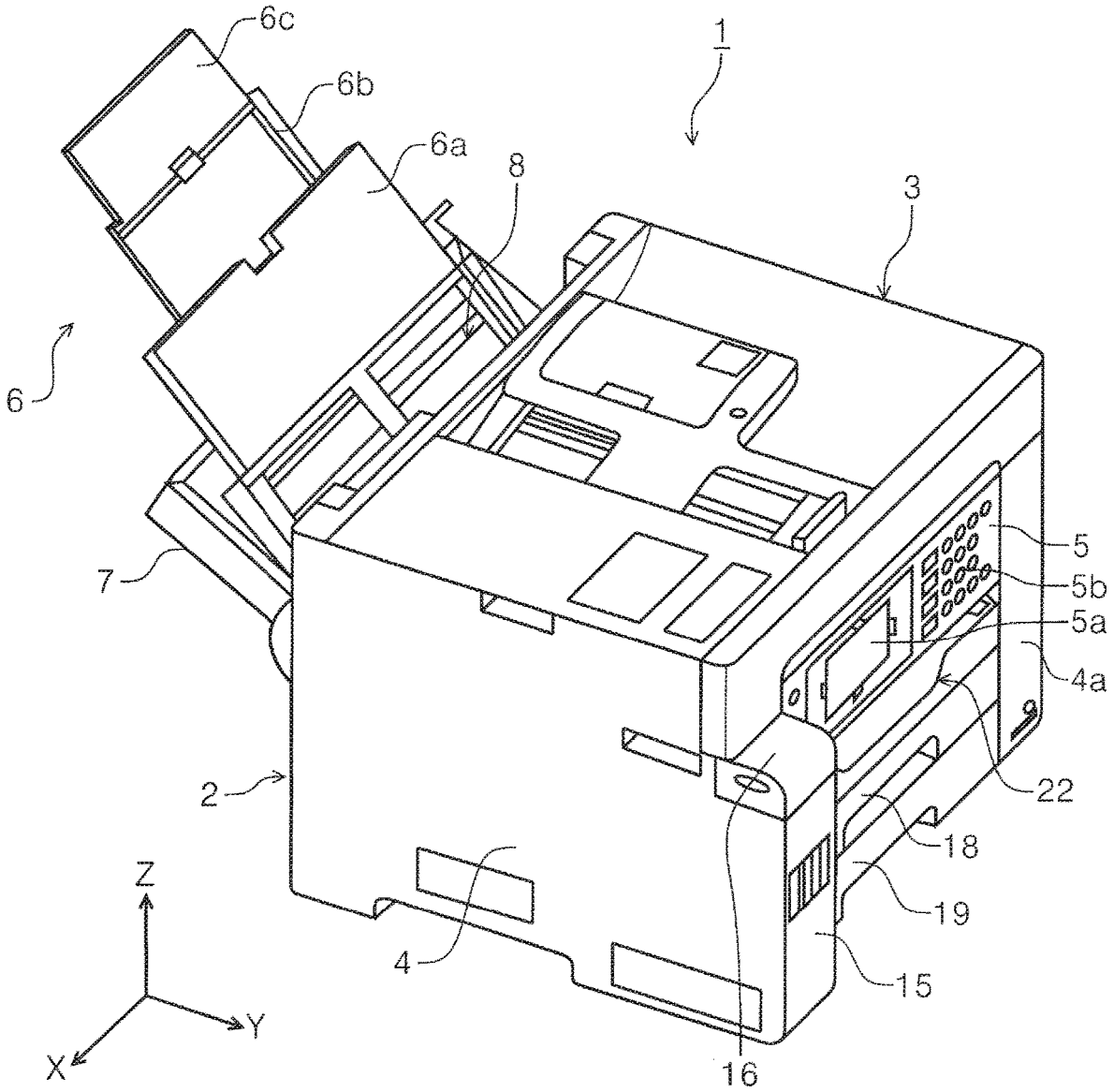
FIG. 3 is a perspective view of the printer when the ejected paper tray is in the housed state and a feeding tray is in an extended state.

In FIGS. 1, 2, and 3, an ink-jet printer 1 is equipped with a scanner section 3 on the top of the apparatus body 2. The ink-jet printer 1 is an example of a recording apparatus. The scanner section 3 is an example of an image reading apparatus. In the description below, a shorter term "printer" is used for an ink-jet printer. A cabinet 4 is the armor of the apparatus body 2. The reference sign 4*a* denotes the front of the cabinet 4, meaning the front of the apparatus body 2. The apparatus body 2 has a function of performing recording on paper, which is an example of a medium. The scanner section 3 has a function of reading a document. The apparatus body 2 includes a paper transportation path R (described later) and a recording head 34 (see FIG. 6). The recording head 34 is an example of a recording unit. The apparatus body 2 includes two medium containers at its bottom part. More specifically, the apparatus body 2 includes a first paper cassette 18 and a second paper cassette 19, which are detachable.

The apparatus body 2 is configured such that a user is able to set paper that is to be fed from the rear toward the front of the apparatus, in addition to the setting of paper into the first paper cassette 18 and the second paper cassette 19. The reference numeral 7 denotes a cover that is opened and closed around a paper setting port 8 (see FIG. 3), which is used when paper is set at the rear of the apparatus. The paper setting port 8 becomes exposed as illustrated in FIG. 3 when the cover 7 is opened. In addition, a feeding tray 6 becomes extendable when the cover 7 is opened. The feeding tray 6 includes telescopic trays 6*a*, 6*b*, and 6*c*. That is, the feeding tray 6 has a multiple-tray structure.

The apparatus body 2 includes the tilt panel 5 on its front. The tilt panel 5 is tiltable such that its panel face is inclined. The tilt panel 5 includes a display section 5*a*, on which various kinds of information are to be displayed, and an operation section 5*b*, which is used for performing various operations. The various kinds of information displayable on the display section 5*a* include various kinds of alert information. The display section 5*a* may be configured as a touch panel that not only displays information but also accepts an operation input.

An ejected paper tray 22, which serves as a medium receiving tray that receives paper ejected after recording thereon, is provided under the tilt panel 5. In the present embodiment, the ejected paper tray 22 includes a first ejected paper tray 23 and a second ejected paper tray 24. The ejected paper tray 22 is switchable between a housed state and a protruding state. The ejected paper tray 22 is retracted inside the apparatus body 2 when in the housed state as illustrated in FIGS. 1 and 3. When in the protruding state, the ejected paper tray 22 protrudes from the apparatus body 2 in the +Y direction as illustrated in FIG. 2, relative to the housed state. The state of the ejected paper tray 22 is switched by motive power of a power source described later.

Figure 5:
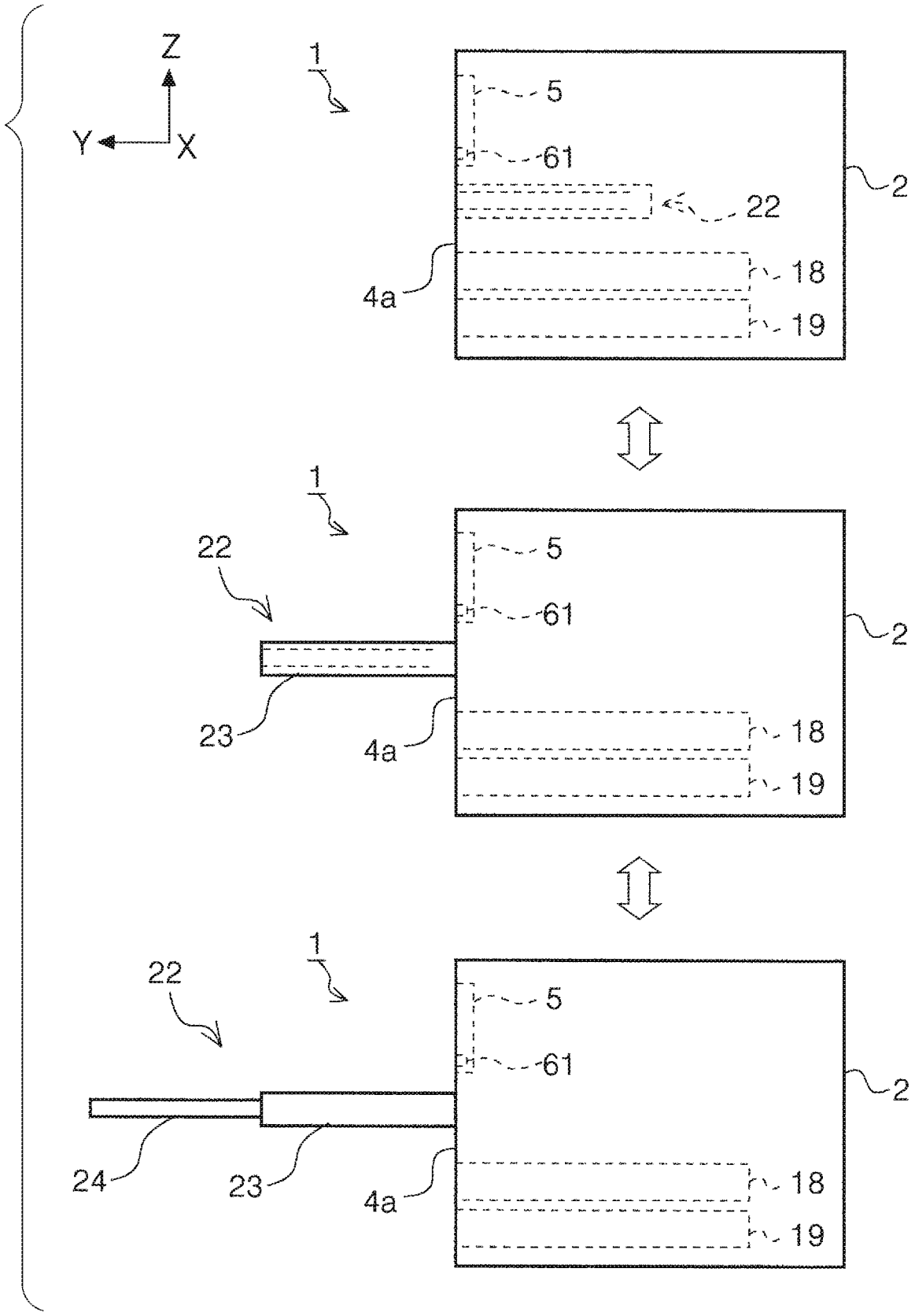
FIG. 5 is a side view illustrating the housed state, a first protruding state, and the second protruding state of the ejected paper tray.

More specifically, as illustrated in FIG. 5, the ejected paper tray 22 is able to be set into two protruding states. The uppermost part of FIG. 5 illustrates the housed state. The ejected paper tray 22 is able to be switched from the housed state into a first protruding state illustrated in the middle part of FIG. 5. In the first protruding state, the second ejected paper tray 24 does not protrude beyond the first ejected paper tray 23 in the +Y direction. The ejected paper tray 22 is able to be switched from the first protruding state into a second protruding state illustrated in the lowermost part of FIG. 5. In the second protruding state, the second ejected paper tray 24 protrudes beyond the first ejected paper tray 23 in the +Y direction. The ejected paper tray 22 is able to receive paper of larger sizes when in the second protruding state than in the first protruding state.

In the example described above, the first ejected paper tray 23 protrudes while keeping a positional relationship of the second ejected paper tray 24 with the first ejected paper tray 23 when the ejected paper tray 22 is switched from the housed state into the first protruding state. However, the ejected paper tray 22 may be switched into the first protruding state by the protruding motion of the second ejected paper tray 24 alone with the first ejected paper tray 23 remaining retracted inside the apparatus body 2. Alternatively, the ejected paper tray 22 may be switched into the first protruding state both by the protruding motion of the first ejected paper tray 23 to some extent and by the protruding motion of the second ejected paper tray 24 to some extent. In the present embodiment, the ejected paper tray 22 is made up of two members, that is, the first ejected paper tray 23 and the second ejected paper tray 24. However, the ejected paper tray 22 may be made up of three or more members. Alternatively, the ejected paper tray 22 may be made up of a single member only.

Figure 4:
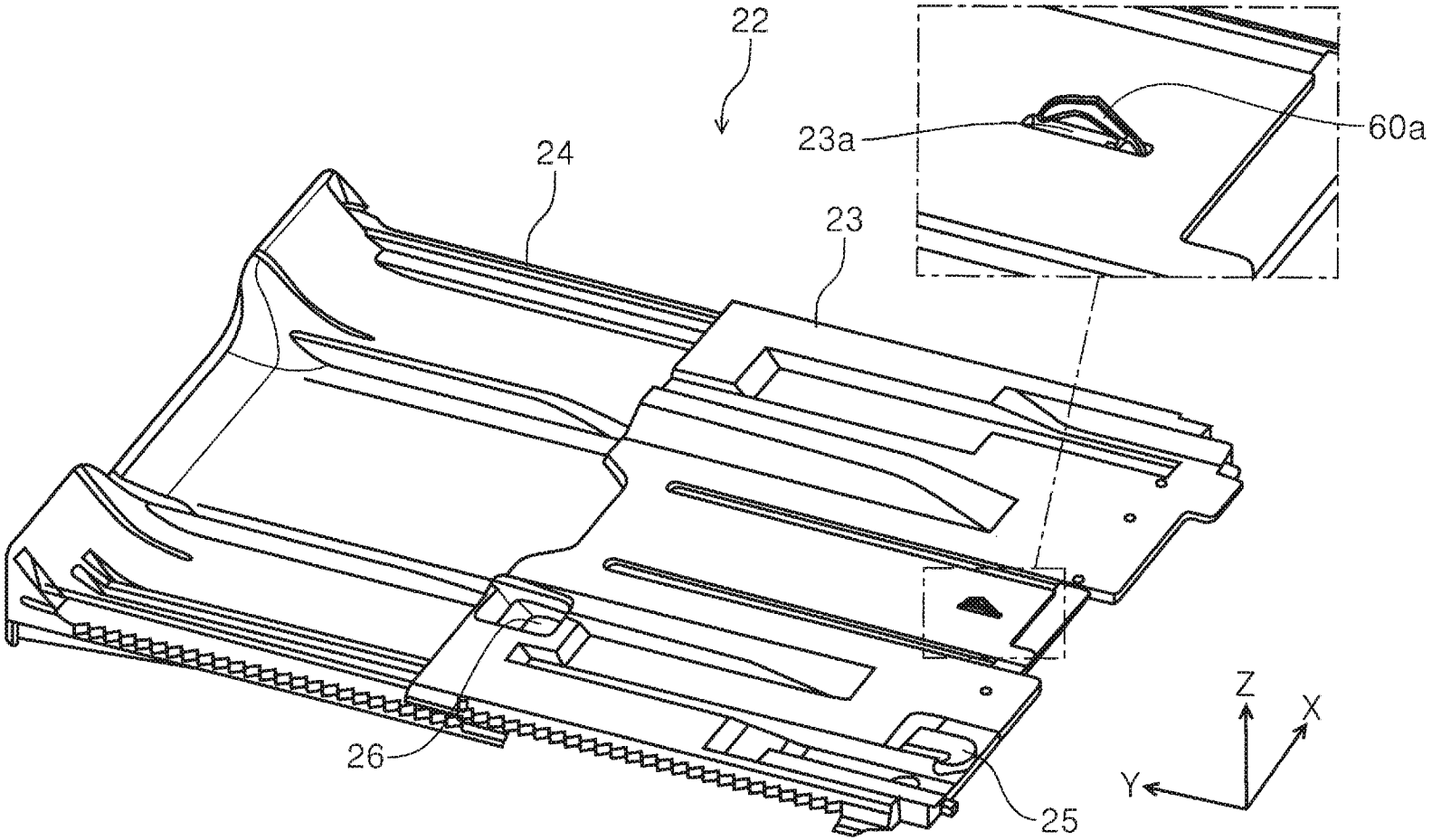
FIG. 4 is a perspective view of the ejected paper tray.

The ejected paper tray 22 is detachable from the apparatus body 2. In FIG. 4, the reference numeral 25 denotes a hook. Due to engagement of the hook 25 with a non-illustrated engagement section provided on the apparatus body 2, the ejected paper tray 22 becomes locked onto the apparatus body 2. The hook 25 is rotatable on an X-Z plane by operation of an operation knob 26. It is possible to disengage the hook 25 from the engagement section mentioned here by rotating the hook 25 by operating the operation knob 26. That is, the rotation of the hook 25 unlocks the ejected paper tray 22 from the apparatus body 2.

As illustrated in FIGS. 1, 2, and 3, an ink container section 15 is provided at the left side on the front of the apparatus body 2. Ink containers (not illustrated) for containing ink are provided inside the ink container section 15. Ink is supplied from the ink containers to the recording head 34 (see FIG. 6) through non-illustrated ink tubes. A cover 16 that can be opened and closed is provided at the top of the ink container section 15. Opening the cover 16 makes the inside accessible for ink replenishment.

Figure 6:
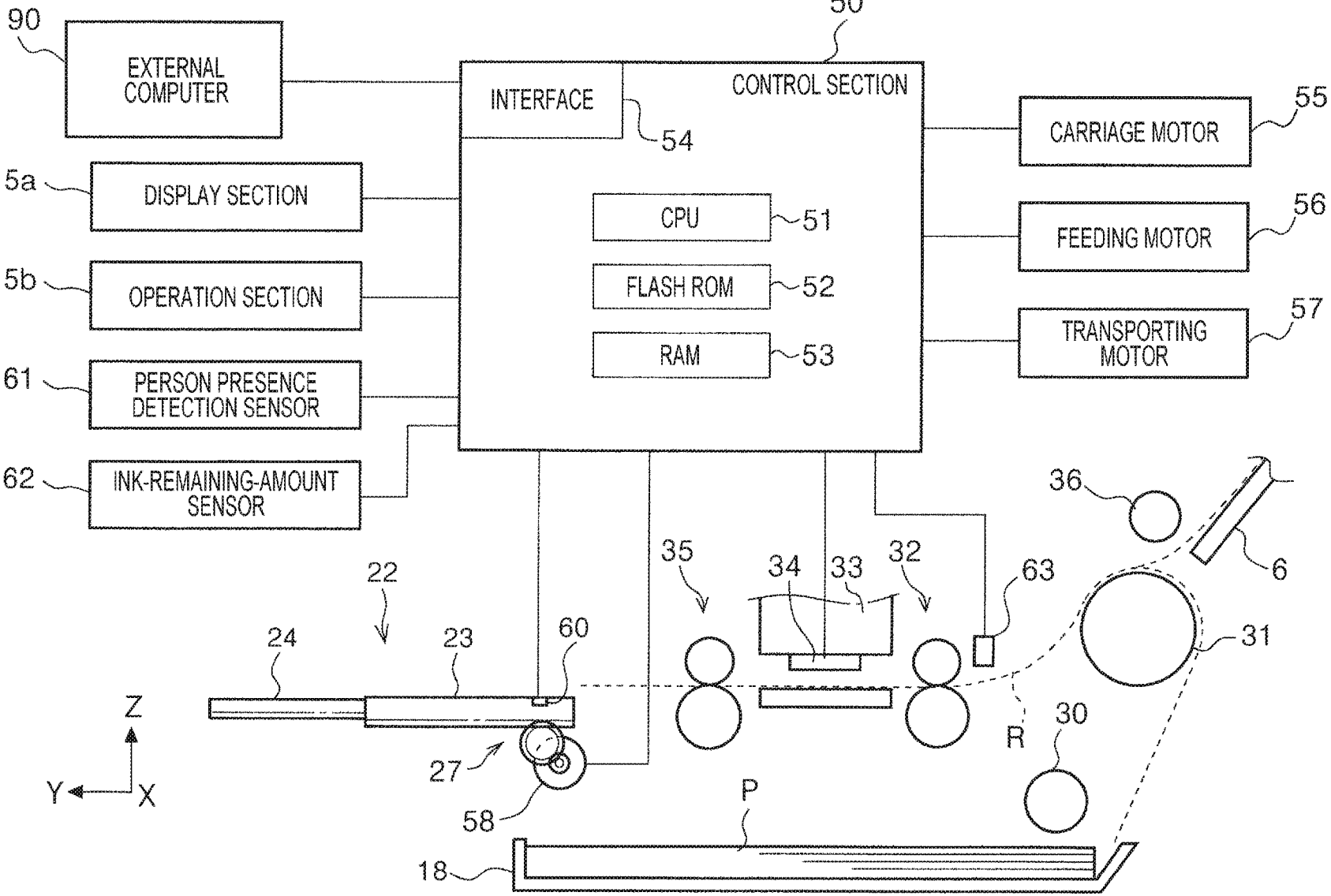
FIG. 6 is a diagram illustrating paper transportation paths and a control system in the printer.

Next, with reference to FIG. 6, a control system and paper transportation paths in the printer 1 will now be explained. For simple illustration, the second paper cassette 19 is not shown in FIG. 6. First, a brief explanation of paper transportation paths is given below. A broken-line curve denoted as the reference sign R denotes a paper transportation path. The reference sign P denotes sheets of paper loaded in the first paper cassette 18. The paper P receives a movement force from a feeding roller 30, is further fed by a reversing roller 31, and then arrives at a pair of transporting rollers 32. On the other hand, paper placed on the feeding tray 6 receives a movement force from a feeding roller 36 to move downward, is further fed by the reversing roller 31, and then arrives at the pair of transporting rollers 32.

The recording head 34 serving as an ink ejection head is provided downstream of the pair of transporting rollers 32. The recording head 34 is mounted on a carriage 33. The carriage 33 reciprocates in the X-axis direction. A pair of ejection rollers 35 is provided downstream of the recording head 34. The paper after recording receives a movement force from the pair of ejection rollers 35 and is then ejected onto the ejected paper tray 22.

Next, a control system will now be explained. A control section 50, which is an example of a control unit, performs various kinds of control of the printer 1, including, for example, feeding a sheet of paper, transporting the paper, recording an image on the paper, and ejecting the paper. The control performed by the control section 50 includes the control of the scanner section 3. However, in FIG. 6, the illustration of the scanner section 3 is omitted. Signals sent from the operation section 5*b* are inputted into the control section 50. Signals for display on the display section 5*a*, in particular, signals for realizing a user interface (UI), are transmitted from the control section 50 to the display section 5*a*.

The control section 50 controls a carriage motor 55, a feeding motor 56, a transporting motor 57, and a tray driving motor 58. In the present embodiment, each of these motors is a DC motor. The feeding motor 56 is a driving source for the feeding rollers 30 and 36 and the reversing roller 31. The transporting motor 57 is a driving source for the pair of transporting rollers 32 and the pair of ejection rollers 35. The tray driving motor 58 is a motive power source that supplies motive power for the state switchover of the ejected paper tray 22. The ejected paper tray 22 is driven via a rack-and-pinion mechanism 27. Driven by this motive power, the ejected paper tray 22 extends and contracts in the Y-axis direction, thereby being switched from one to another of the states explained above with reference to FIG. 5.

Detection signals sent from various sensors are also inputted into the control section 50. The various sensors include a paper detection sensor 63, which is a sensor for detecting the passing of paper. Based on an output signal of the paper detection sensor 63, the control section 50 is able to detect the passing of the leading edge and the trailing edge of a sheet of paper. If there is no change in the output signal of the paper detection sensor 63 despite driving a paper feeding unit such as, for example, the feeding rollers 30 and 36 and the reversing roller 31 by a predetermined amount, the control section 50 is able to determine that paper has run out. If there is no change in the output signal of the paper detection sensor 63 despite driving the pair of transporting rollers 32 by a predetermined amount after the arrival of the leading edge of a sheet of paper, the control section 50 is able to determine that a paper jam has occurred. The various sensors further include a paper detector 60. The paper detector 60 is provided on the ejected paper tray 22. Based on a detection signal outputted from the paper detector 60, the control section 50 is able to determine whether there is paper on the ejected paper tray 22 or not. The various sensors further include an ink-remaining-amount sensor 62. Based on a detection signal outputted from the ink-remaining-amount sensor 62, the control section 50 is able to detect that ink has run out, that is, detect that the amount of the ink left in the ink container section 15 (see FIGS. 1, 2, and 3) has decreased to an extent that makes it impossible to print an image anymore.

In the present embodiment, the paper detector 60 is provided at an upstream position on the first ejected paper tray 23. The position of the paper detector 60 in the X-axis direction is the X-directional center of the first ejected paper tray 23. Since the paper detector 60 is provided at the position explained here, it is possible to detect paper even if the paper has the minimum size among a plurality of sizes of paper that might be used. The paper detector 60 includes a detection lever 60*a*. The detection lever 60*a* is able to rotate on a Y-Z plane around a non-illustrated rotation shaft. The detection lever 60*a* protrudes upward through an opening 23*a* formed in the first ejected paper tray 23. When paper is ejected onto the ejected paper tray 22, the detection lever 60*a* changes its position downward due to the weight of the paper. This causes a change in the detection signal outputted from the paper detector 62. However, the paper detector 60 is not limited to such a contact-type sensor. The paper detector 60 may be a contactless sensor such as an optical sensor.

A person presence detection sensor 61 is provided in the tilt panel 5 (see FIG. 5). In the present embodiment, the person presence detection sensor 61 is an infrared sensor and senses a change in the amount of infrared radiation when someone walks by. Because of this sensing, the control section 50 is able to detect the presence of a person approaching the printer 1. The person presence detection sensor 61 is not limited to an infrared sensor. A sensor of a different detection scheme, for example, a motion sensor that detects the movement of a person by analyzing video, may be used instead.

Next, the components of the control section 50 will now be explained. The control section 50 includes a CPU 51, a flash ROM 52, and a RAM 53. The CPU 51 performs various kinds of arithmetic processing in accordance with a program stored in the flash ROM 52 and controls the operation of the printer 1 as a whole. The program stored in the flash ROM includes a control program that realizes a control flow explained later with reference to FIG. 7 and a control program that realizes a control flow explained later with reference to FIG. 8. The flash ROM 52, which is an example of a storage unit, is a readable-and-writeable non-volatile memory. Various kinds of setting information inputted by a user via the operation section 5*b* are also stored in the flash ROM 52. Various kinds of information are temporarily stored in the RAM 53, which is an example of the storage unit. The control section 50 includes an interface 54 and is able to communicate with an external computer 90 via the interface 54.

Next, with reference to FIGS. 7 and 8, the control of the ejected paper tray 22, which is performed by the control section 50, will now be explained. First, with reference to FIG. 7, an explanation is given below of the control of the ejected paper tray 22 performed when an error occurs. Upon the start of a recording job (Yes in a step S101), the control section 50 causes the ejected paper tray 22 to move frontward, specifically, switches the ejected paper tray 22 from the housed state (the uppermost part of FIG. 5) into the first protruding state (the middle part of FIG. 5) or into the second protruding state (the lowermost part of FIG. 5) (step S102). Whether to select the first protruding state or the second protruding state depends on paper size information that is contained in driver information. The term "recording job" mentioned here means a series of recording operations that are executed in response to a recording execution instruction given once by a user. In some instances, the recording job ends by performing printing on a single sheet of paper. In other instances, the recording job ends by performing printing on a plurality of sheets of paper.

Next, the control section 50 determines whether an error has occurred or not, and this error determination is repeated until the recording job ends (steps S103 and S104). The error mentioned here is any of, for example, the running out of paper, the running out of ink, and a paper jam. If an error has occurred (Yes in the step S104), the recording operations are suspended (a step S105), and a first alert is outputted (a step S106). The first alert mentioned here is to display the content of the error on the display section 5*a*. For example, if the content of the error is the running out of paper, the following alert message is displayed on the display section 5*a*, accompanied by, if necessary, a solution as to how to clear the error: "Empty: Paper is not set." If the content of the error is the running out of ink, the following alert message is displayed on the display section 5*a*, accompanied by, if necessary, a solution as to how to clear the error: "The amount of ink left is less than the limit." If the content of the error is a paper jam, the following alert message is displayed on the display section 5*a*, accompanied by, if necessary, a solution as to how to clear the error: "Paper is jammed."

Next, the control section 50 performs processing in a step S107 and subsequent steps and, concurrently with this processing, performs processing in a step S114. First, the processing performed in the step S107 and the subsequent steps will now be explained. Based on detection information of the paper detector 60, the control section 50 determines whether there is paper on the ejected paper tray 22 or not (the step S107). If it is determined as the result of this determination that there is no paper on the ejected paper tray 22 (No in the step S107), the ejected paper tray 22 is switched into the housed state (a step S110).

If there is paper on the ejected paper tray 22 (Yes in the step S107), a second alert is outputted (a step S108). The second alert mentioned here is to prompt the user to take the print output away from the ejected paper tray 22. For example, an alert message saying, "Please remove the sheets from the ejected paper tray", is displayed on the display section 5*a*. It will be advantageous if the second alert mentioned here is displayed on the same screen as that of the first alert mentioned above. If it is determined that the sheets have been removed from the ejected paper tray 22 as the result of the alerting (No in a step S109), the ejected paper tray 22 is switched into the housed state (the step S110).

After the above steps, if the error notified by the first alert has been cleared (Yes in a step S111), the control section 50 causes the ejected paper tray 22 to move frontward to switch the ejected paper tray 22 from the housed state back into the original state, that is, the first protruding state or the second protruding state (a step S112), and resumes the recording operations (a step S113). If the content of the error is the running out of paper, the error notified by the first alert is cleared by paper replenishment followed by pressing "OK" of the operation section 5*b* by the user. If the content of the error is the running out of ink, the error notified by the first alert is cleared by ink replenishment followed by pressing "OK" of the operation section 5*b* by the user. If the content of the error is a paper jam, the error notified by the first alert is cleared by removing the jammed paper followed by pressing "OK" of the operation section 5*b* by the user.

Some users sometimes take an action to clear the error the content of which was notified by the first alert without doing anything regarding the second alert (the step S108), that is, with the print output remaining placed on the ejected paper tray 22. If the error is cleared in this way (Yes in the step S114), the recording operations are resumed (the step S113).

Next, with reference to FIG. 8, an explanation is given below of the control of the ejected paper tray 22 performed when the printer 1 returns from a power saving mode. First, upon completion of a recording job, the control section 50 causes the display section 5*a* to display a message for prompting the user to take the print output away from the ejected paper tray 22, for example, a message saying, "Please remove the sheets from the ejected paper tray." If the sheets have been removed from the ejected paper tray 22 as the result of the alerting, the ejected paper tray 22 is switched into the housed state.

Some users, however, might leave the print output on the ejected paper tray 22 without removing it. The control section 50 shifts into a power saving mode, in which power consumption is lower, if a predetermined time has elapsed in a standby state, in which no recording operation is executed. In the power saving mode, power is not supplied to the motors, and the display section 5*a* is OFF.

Figure 8:
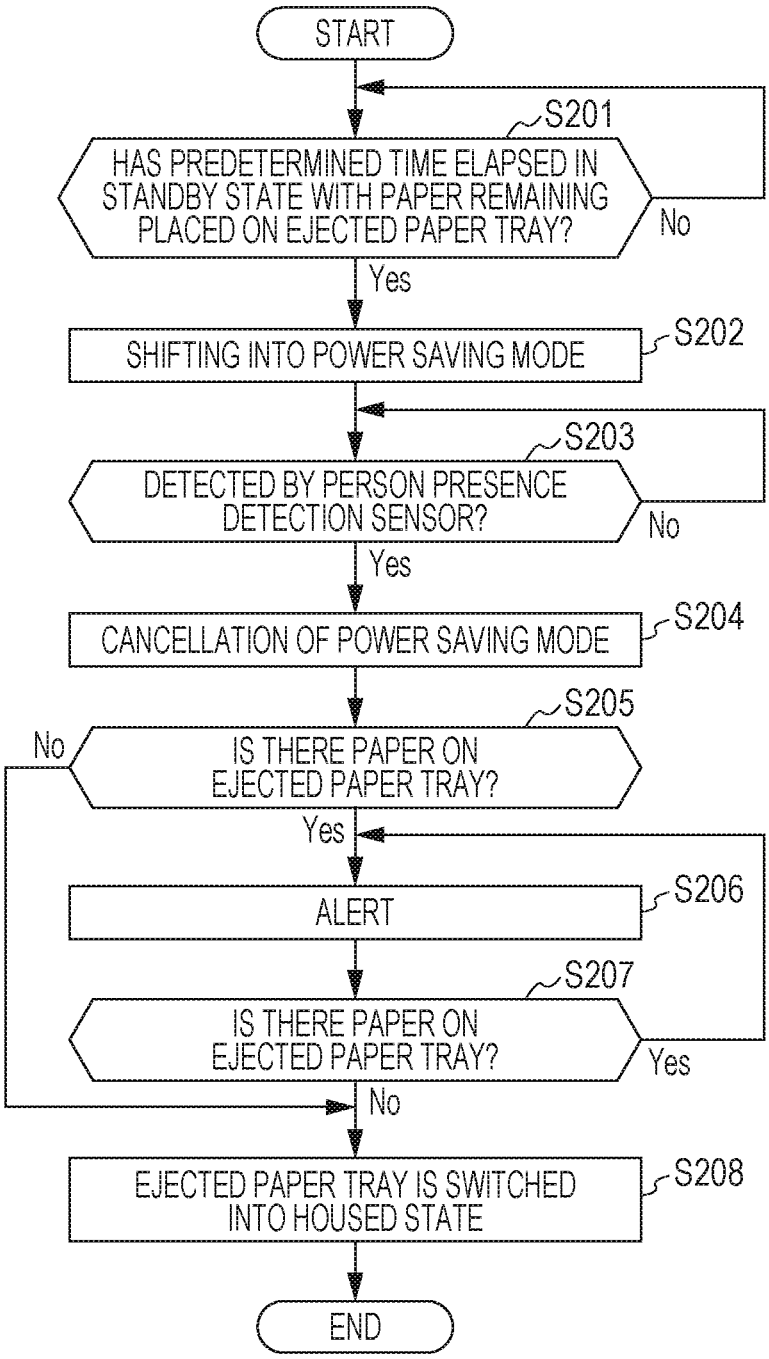
FIG. 8 is a flowchart illustrating the control of the ejected paper tray when returning from a power saving mode.

FIG. 8 illustrates control performed when a shift into the power saving mode occurs with paper remaining placed on the ejected paper tray 22. If the predetermined time has elapsed in the standby state with the paper remaining placed on the ejected paper tray 22 (Yes in a step S201), the control section 50 shifts into the power saving mode (a step S202). Of course, a shift into the power saving mode occurs if the predetermined time has elapsed, even without paper on the ejected paper tray 22. The length of time T1 until shifting into the power saving mode with the paper remaining placed on the ejected paper tray 22 may be the same as the length of time T2 until shifting into the power saving mode with no paper remaining placed on the ejected paper tray 22. Alternatively, the time T1 may be longer than the time T2. If the time T1 is longer than the time T2, it is possible to expect that the user will be more likely to remove the sheets from the ejected paper tray 22. The timing of starting the counting of the time T1 and the time T2 may be, for example, the point in time of the completion of the recording job. More specifically, the counting of the time T1 and the time T2 may be started at the timing of stopping the driving of all of the motors.

In the present embodiment, power supply to the person presence detection sensor 61 continues even after shifting into the power saving mode. If the person presence detection sensor 61 detects that a person approaches the printer 1 when in the power saving mode (a step S203), the control section 50 cancels the power saving mode (a step S204). Next, the control section 50 determines whether there is paper on the ejected paper tray 22 or not (a step S205). If there is no paper on the ejected paper tray 22 (No in the step S205), the ejected paper tray 22 is switched into the housed state (a step S208).

If there is paper on the ejected paper tray 22 (Yes in the step S205), an alert is outputted (a step S206). The alert mentioned here is to prompt the user to take the print output away from the ejected paper tray 22. For example, an alert message saying, "Please remove the sheets from the ejected paper tray", is displayed on the display section 5*a*. If it is determined that the sheets have been removed from the ejected paper tray 22 as the result of the alerting (No in a step S207), the ejected paper tray 22 is switched into the housed state (a step S208).

Figure 7:
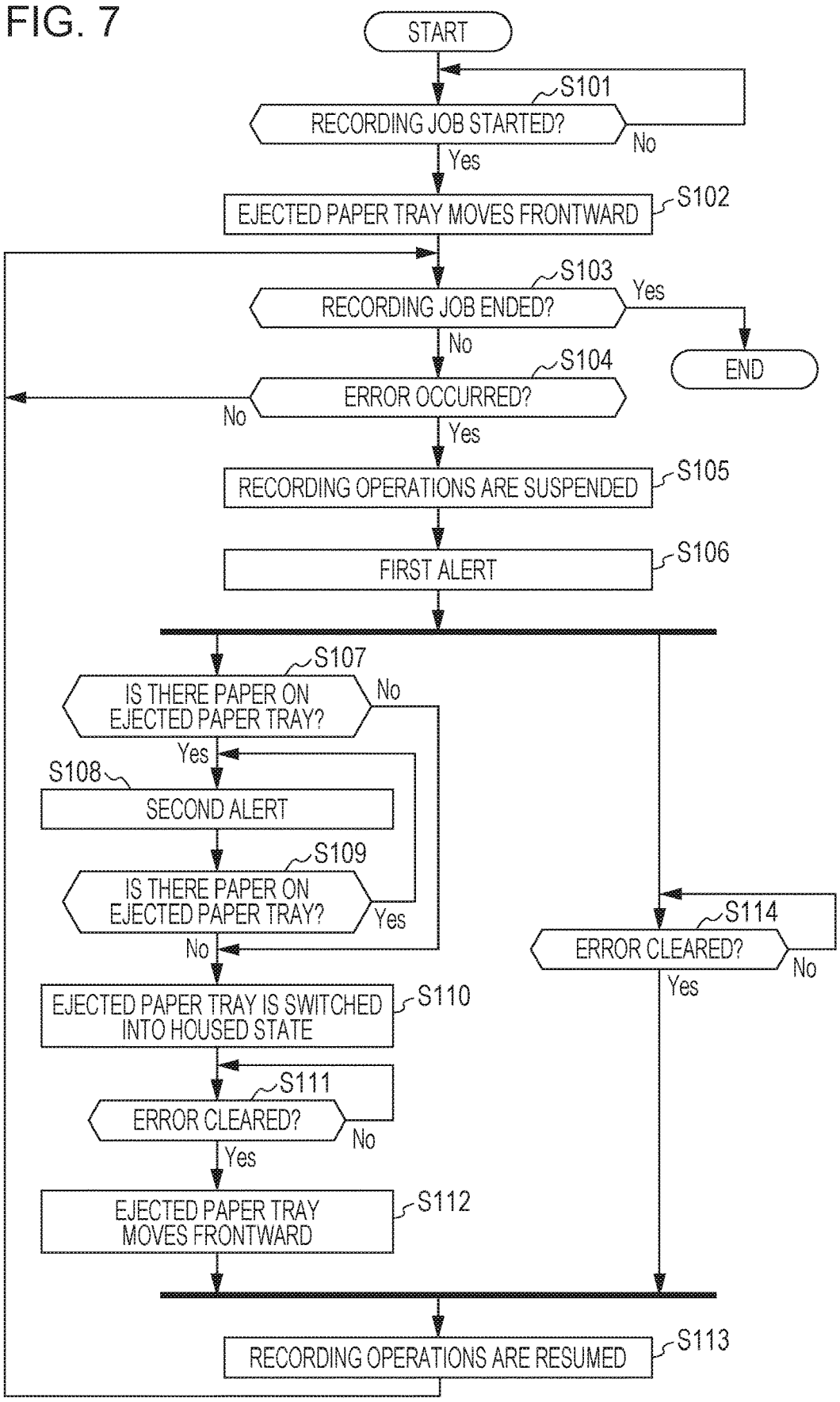
FIG. 7 is a flowchart illustrating the control of the ejected paper tray when an error occurs.

As explained above, the paper detector 60 is an example of a medium detection unit that detects whether there is paper on the ejected paper tray 22 or not, and, if an error is detected during the execution of a recording job, the control section 50, which controls the tray driving motor 58 based on detection information of the paper detector 60, determines whether there is paper on the ejected paper tray 22 or not and switches the ejected paper tray 22 into the housed state if it is determined that there is no paper on the ejected paper tray 22 (the step S110 in FIG. 7). Specifically, if an error occurs during the execution of a recording job, the user takes an action suitable for clearing the error on the printer 1. If the ejected paper tray 22 were in the first protruding state or the second protruding state, the ejected paper tray 22 might be obstructive to the user's work when the user attempts to clear the error. The ejected paper tray 22 is, however, switched into the housed state as described above. Therefore, it is possible to prevent the ejected paper tray 22 from being obstructive when the user takes an action suitable for clearing the error on the printer 1.

If it is determined that there is paper on the ejected paper tray 22, the control section 50 outputs an alert for prompting the user to remove the paper from the ejected paper tray 22 (the step S108 in FIG. 7). After the alert is outputted, if it is determined that there is no paper on the ejected paper tray 22, the control section 50 switches the ejected paper tray 22 into the housed state (the step S110 in FIG. 7). That is, since an alert for prompting the user to remove the paper from the ejected paper tray 22 is outputted if it is determined that there is paper on the ejected paper tray 22, it is possible to expect that the user prompted by the alert will remove the paper from the ejected paper tray 22. Since the ejected paper tray 22 is switched into the housed state if it is then determined that there is no paper on the ejected paper tray 22, it is possible to prevent the ejected paper tray 22 from being obstructive when the user takes an action suitable for clearing the error on the printer 1.

The apparatus body 2 includes the first paper cassette 18 and the second paper cassette 19, which serve as a paper container section that contains paper that is to be fed. The error (the step S104 in FIG. 7) includes a "running-out-of-paper" error caused due to the absence of paper in the cassette(s). If paper has run out, the user takes an action such as detaching the first paper cassette 18 or the second paper cassette 19 from the apparatus body 2 or replenishing the first paper cassette 18 or the second paper cassette 19 with paper with the first paper cassette 18 or the second paper cassette 19 remaining attached to the apparatus body 2. Since the ejected paper tray 22, which is located above these cassettes, is switched into the housed state, it is possible to prevent the ejected paper tray 22 from being obstructive to the user's work when such an action is taken.

The apparatus body 2 is equipped with the ejected paper tray 22 in the front portion of the apparatus and is equipped with the feeding tray 6, on which paper to be fed is placed, in the rear portion of the apparatus. The error (the step S104 in FIG. 7) includes a "running-out-of-paper" error caused due to the absence of paper on the feeding tray 6. If paper on the feeding tray 6 has run out, the user takes an action, specifically, replenishes the feeding tray 6 located behind the apparatus body 2 with paper. Since the ejected paper tray 22 in the front portion of the apparatus is switched into the housed state, it is possible to prevent the ejected paper tray 22 from being obstructive to the user's work when such an action is taken.

The error (the step S104 in FIG. 7) includes a paper-jam error caused by paper getting jammed inside the apparatus body 2. In order to clear this error, the user takes an action, specifically, removes the jammed paper out of the apparatus body 2. Since the ejected paper tray 22 is switched into the housed state, it is possible to prevent the ejected paper tray 22 from being obstructive to the user's work in the process of removing the jammed paper.

The error (the step S104 in FIG. 7) includes an error caused due to the running out of ink. In order to clear this error, the user takes an action for ink replenishment. Since the ejected paper tray 22 is switched into the housed state, it is possible to prevent the ejected paper tray 22 from being obstructive to the user's work in this process.

As explained above with reference to FIG. 8, the control section 50 shifts into the power saving mode if the predetermined time has elapsed in the recording standby state while the ejected paper tray 22 is in the protruding state with paper placed on the ejected paper tray 22. If the person presence detection sensor 61 detects the approaching of a person during the execution of the power saving mode, the control section 50 returns from the power saving mode. The control section 50 determines whether there is paper on the ejected paper tray 22 or not when returning from the power saving mode. The control section 50 switches the ejected paper tray 22 into the housed state (the step S208 in FIG. 8) if it is determined that there is no paper on the ejected paper tray 22.

The ejected paper tray 22 cannot be switched into the housed state if there is paper on the ejected paper tray 22. If the printer 1 shifts into the power saving mode with the ejected paper tray 22 left in the protruding state, the ejected paper tray 22 cannot be driven even when the paper is removed from the ejected paper tray 22. By contrast, in the present embodiment, if the person presence detection sensor 61 detects the approaching of a person, the control section 50 returns from the power saving mode, determines whether there is paper on the ejected paper tray 22 or not when returning from the power saving mode, and switches the ejected paper tray 22 into the housed state if it is determined that there is no paper on the ejected paper tray 22. Therefore, it is possible to prevent the ejected paper tray 22 from obstructing the person to pass.

The control section 50 determines whether there is paper on the ejected paper tray 22 or not when returning from the power saving mode, outputs an alert (S206 in FIG. 8) for prompting the user to remove the paper from the ejected paper tray 22 if there is paper on the ejected paper tray 22, and switches the ejected paper tray 22 into the housed state (S208 in FIG. 8) if it is then determined that there is no paper on the ejected paper tray 22. Because of this procedure, the removal of the paper from the ejected paper tray 22 can be expected. Since the ejected paper tray 22 is switched into the housed state if it is determined after the removal of the paper that there is no paper on the ejected paper tray 22, it is possible to prevent the ejected paper tray 22 from obstructing a person to pass.

The scope of the present disclosure is not limited to the foregoing embodiments. The present disclosure can be modified in various ways within the scope of the recitation of appended claims. Needless to say, such modifications are within the scope of the present disclosure.

What is claimed is:

1. A recording apparatus, comprising:

an apparatus body that includes a recording unit that performs recording on a medium;

a medium receiving tray that is switchable between a housed state, in which the medium receiving tray is retracted inside the apparatus body, and a protruding state, in which the medium receiving tray protrudes from the apparatus body relative to the housed state, the medium receiving tray being configured to receive the medium ejected when in the protruding state;

a power source that switches the medium receiving tray between the housed state and the protruding state;

a medium detection unit that detects whether there is the medium on the medium receiving tray or not; and a control unit that controls the power source based on detection information of the medium detection unit; wherein when an error is detected during execution of a recording job, the control unit determines whether there is the medium on the medium receiving tray or not, when the medium detection unit determines that there is the medium on the medium receiving tray, the control unit outputs an alert for prompting the medium to be removed from the medium receiving tray, when the control unit determines that there is no medium on the medium receiving tray, the control unit switches the medium receiving tray into the housed state, and when the error is resolved, the control unit switches the medium receiving tray into the protruding state and the recording job is resumed.

2. The recording apparatus according to claim 1, wherein the apparatus body includes, below the medium receiving tray, a medium container unit inside which the medium to be fed is containable, and the error is an error caused due to running out of the medium inside the medium container unit.

3. The recording apparatus according to claim 1, wherein the apparatus body includes the medium receiving tray in a front portion of the recording apparatus and a feeding tray in a rear portion of the recording apparatus, the medium to be fed being configured to be placed on the feeding tray, and the error is an error caused due to running out of the medium on the feeding tray.

4. The recording apparatus according to claim 1, wherein the error is an error caused due to jamming of the medium inside the apparatus body.

5. The recording apparatus according to claim 1, wherein the recording unit is an ink ejection head that ejects ink onto the medium, and the error is an error caused due to running out of the ink.

* * * * *